US006698214B2

(12) United States Patent
Chordia

(10) Patent No.: US 6,698,214 B2
(45) Date of Patent: Mar. 2, 2004

(54) METHOD OF REFRIGERATION WITH ENHANCED COOLING CAPACITY AND EFFICIENCY

(75) Inventor: Lalit Chordia, Pittsburgh, PA (US)

(73) Assignee: Thar Technologies, INC, Pittsburgh, PA (US)

( * ) Notice: Subject to any disclaimer, the term of this patent is extended or adjusted under 35 U.S.C. 154(b) by 0 days.

(21) Appl. No.: 10/373,526

(22) Filed: Feb. 24, 2003

(65) Prior Publication Data

US 2003/0167791 A1 Sep. 11, 2003

Related U.S. Application Data

(60) Provisional application No. 60/359,030, filed on Feb. 22, 2002.

(51) Int. Cl.[7] ..... F25B 1/00
(52) U.S. Cl. ..... 62/114; 62/502
(58) Field of Search ..... 62/114, 115, 174, 62/498, 502

(56) References Cited

U.S. PATENT DOCUMENTS 4,032,312 A * 6/1977 Anderson ..... 62/498
5,036,679 A * 8/1991 Zlobinsky et al. ..... 62/470
6,082,132 A * 7/2000 Numoto et al. ..... 62/498

FOREIGN PATENT DOCUMENTS

DE 3100019 A1 * 9/1982 ..... 62/114

* cited by examiner

*Primary Examiner*—Melvin Jones

(57) ABSTRACT

This invention relates to a refrigeration method and processes that employ a nontoxic and environmentally benign, oil-free refrigerant in a novel vapor-compression thermodynamic cycle that includes a means for enhancing cooling capacity and efficiency. A means of controlling of the process conditions and flow of the refrigerant are provided. The refrigerant in the invention in used in a transcritical cycle.

43 Claims, 4 Drawing Sheets

Vapor Compression Transcritical Cycle with Turbine

Fig 1. Standard Transcritical Vapor Compression Cycle (Prior Art)
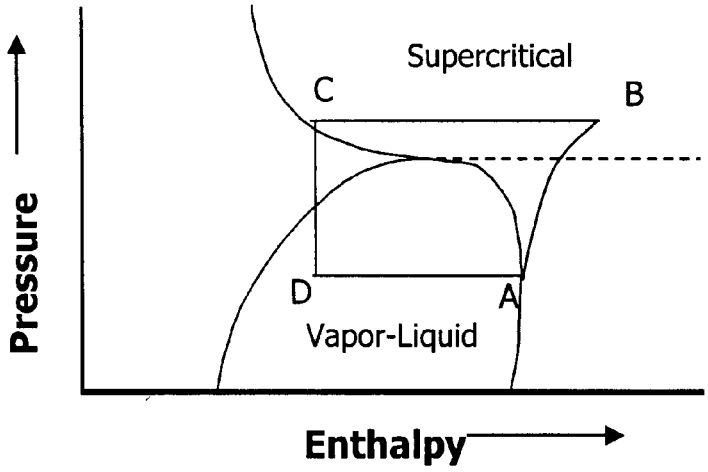

Fig 2. Components for Standard Transcritical Vapor Compression Cycle (Prior Art)
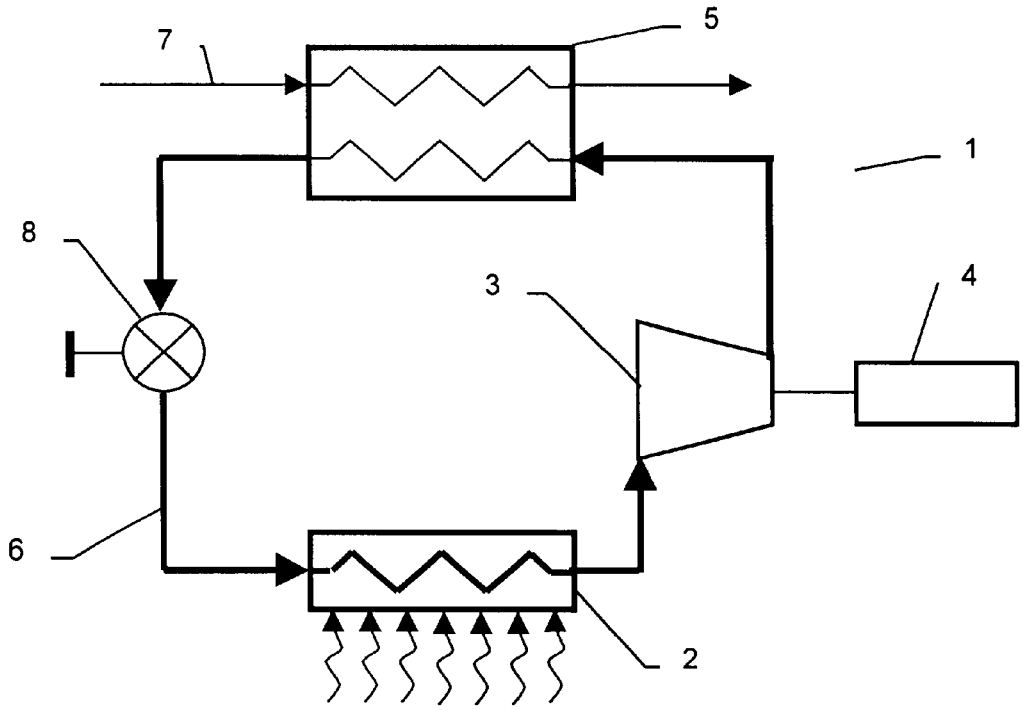

Fig 3. Vapor Compression Transcritical Cycle with Turbine
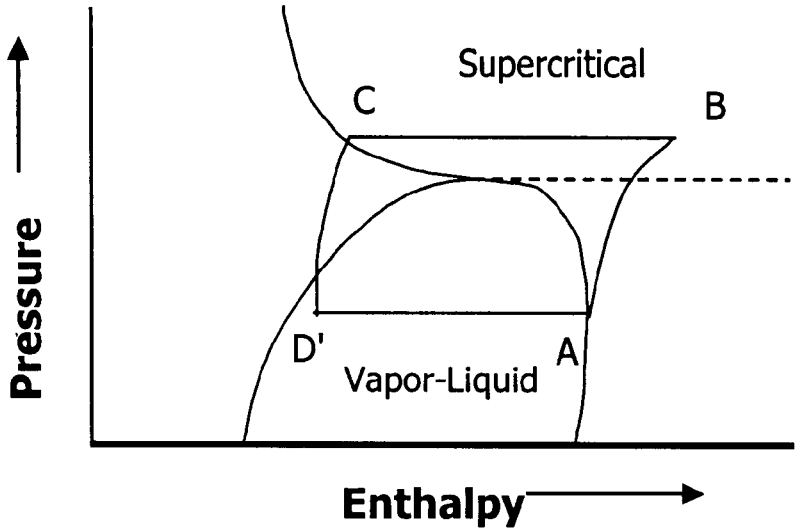

Fig 4. Components for Vapor Compression Transcritical Cycle with Turbine
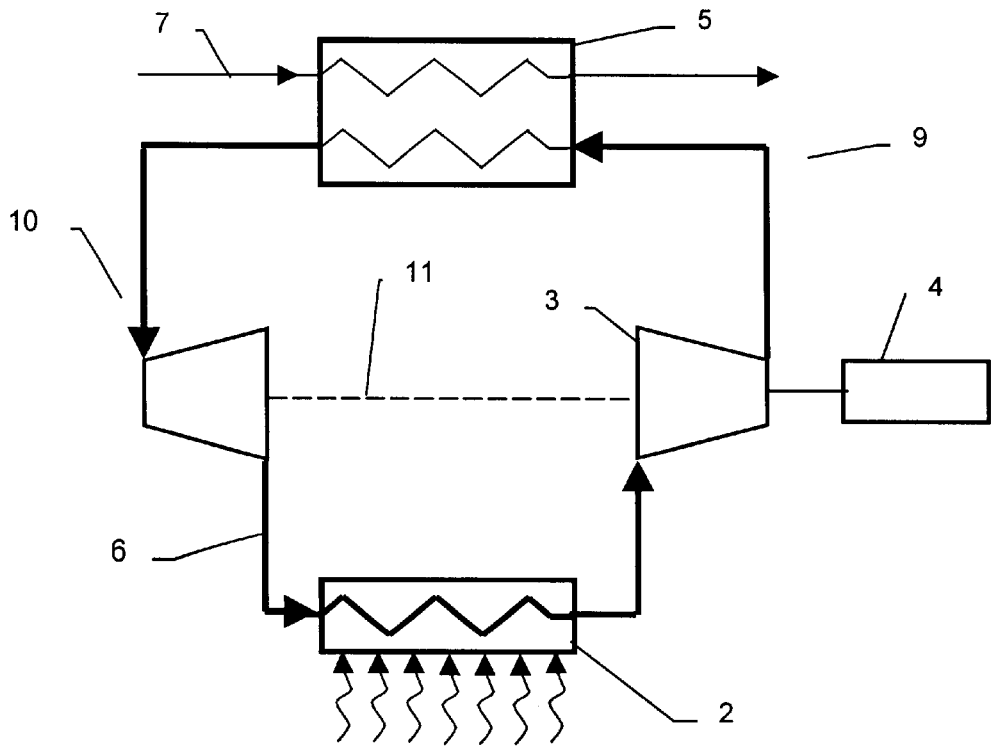

METHOD OF REFRIGERATION WITH ENHANCED COOLING CAPACITY AND EFFICIENCY

CROSS-REFERENCE TO RELATED APPLICATION:

This application claims priority to U.S. Provisional patent application Ser. No. 60/359,030, filed Feb. 22, 2002, teachings of which are incorporated herein by reference.

BACKGROUND OF THE INVENTION

1. Field of the Invention

This invention relates to a refrigeration method that employs a process or processes, whereby a supercritical fluid is used in a vapor-compression thermodynamic cycle, and more particularly to a means of enhancing cooling capacity and efficiency.

2. Background

In conventional vapor-compression refrigeration cycles, heat is absorbed at a constant temperature by a fluid undergoing evaporation, vapor is then compressed to a higher pressure before giving up heat of evaporation, as well as work energy added during compression, in a condenser at a subcritical pressure, before ultimately decompressing through an expander and returning to the evaporator to pick up heat and begin the cycle anew. An alternative to this cycle is to compress the fluid to a supercritical state at a high enough pressure to ensure that it remains in a supercritical state as it releases heat to a cooling medium. In refrigeration cycles, the cooling medium is usually air, but it can be another fluid, such as seawater. Then, as the cooled working fluid is expanded, it returns to a subcritical state and condenses, after which it returns to the evaporator to absorb heat anew. Such a cycle is termed transcritical.

Throughout the history of vapor-compression refrigeration, stretching back over 150 years, subcritical cycles have been the norm. Early refrigeration devices based on carbon dioxide, ammonia or sulfur dioxide, worked in this way. Carbon dioxide was favored for commercial refrigeration in the early part of the Twentieth Century, but lost its importance to chlorofluorocarbon (CFC) refrigerants in the 1930s. These fluids were preferred because they reject heat at lower pressures, thus requiring smaller compressor capacity. They are also deemed non-toxic and safe. Within decades, the use of carbon dioxide as a refrigerant became uncommon.

In the early 1970s, however, the environmental risks posed by CFCs were realized. Theoretical estimations of ozone depletion were bolstered by observations of ozone "holes" over the Antarctic. The United Nations is leading a multinational movement to phase out the use of certain classes of CFCs, or to substitute them with grades that pose less ozone-depletion potential. Nevertheless, even the best substitutes present a long-term risk, and the search is on for a refrigerant that has no ozone-depletion potential. This has led to renewed interest in carbon dioxide.

This revived interest in carbon dioxide, however, comes with a general desire to achieve efficiencies at least as good as those experienced with CFC cycles. Consequently, most recent proposals of refrigeration devices based on carbon dioxide have called for operating under transcritical cycles.

The benefits of supercritical cooling have long been known. Operators of subcritical systems may have on occasion sought to coax more refrigeration capacity from their machines by raising compression pressure to cause more heat exhaustion to occur under supercritical conditions. If the temperature of the ambient cooling fluid rose significantly, as could be the case during hot summer days, this might have been necessary to maintain minimum refrigeration capability.

Brenan (U.S. Pat. No. 4,205,532) drew on this knowledge in patenting a heat pipe. This invention addresses the four basic components of a transcritical cycle: an accepter (or evaporator), a compressor, a rejecter that exhausts heat, and an expansion device. Brenan did not, however, offer a method for controlling the process, nor did he address methods to improve the thermodynamic efficiency of compression or expansion, the points at which the greatest extent of thermodynamic irreversibility take place. Providing control of compression and expansion is therefore needed to improve thermodynamic efficiency.

Lorentzen et at (U.S. Pat. No. 5,245,836) improved on Brenan by presenting a method of control that ensures sufficient mass flow to maintain supercritical conditions between the compressor outlet and expander inlet. The method involves controlling the pressure in the "high" side in or near the rejecter by throttling an expansion valve. Additionally, an accumulator is provided with the dual purpose of ensuring sufficient liquid in the system to maintain evaporation, even if the expander is throttled tightly, as well as to provide a means for separating compressor oil from the working fluid. The presence of compressor oil in the working fluid is a disadvantage, the means of separating the oil from the working fluid notwithstanding, because the heat transfer coefficient of the working fluid is decreased by the presence of the oil, thereby reducing overall efficiency.

Replacing a throttling valve with a turbine for fluid expansion has long been recognized. Williams (U.S. Pat. No. 4,170,116) supplemented a throttling valve with a turbine in series with the valve. Robinson and Groll, in *Int. J. Refrig.*, 1998, elucidated the benefits of a turbine as the expander on its own, without a throttling valve. They demonstrated, by means of simulations, that a turbine can increase the Coefficient of Performance (COP) of a cycle over that which employs a conventional expansion valve. Furthermore, COP reaches an optimum depending on the heat rejection pressure. Means for controlling a practical process were not provided, however.

An important consideration in the application of a turbine is the method of recovering work energy from the turbine. Such methods are undeveloped in current practice. One possibility for work recovery, by which the turbine and the compressor are coupled, is commonplace in refrigeration systems based on air or nitrogen cycles. Transcritical refrigeration cycles, based on carbon dioxide, are emerging, especially in automotive air conditioning applications. The current state-of-the-art, however, has yet to implement all the means possible to achieve highest efficiency. Most significantly, little has been done to improve compressor efficiency. In automotive systems, efficiency is of secondary importance owing to the plentitude of power available from a vehicle's powertrain.

Hazlebeck (U.S. Pat. No. 5,405,533) discloses a supercritical process that relies on thermosyphoning and thus omits the compressor completely. Such a system, however, is highly constrained in terms of the range of operating temperatures and portability. In order to build compact and efficient refrigeration devices, improvements to compressor efficiency and compactness are necessary.

OBJECTS OF THIS INVENTION

It is therefore an object of the present invention to improve the efficiency of the transcritical vapor compression refrigeration cycles and to increase their capacity.

Another object of the present invention is to simplify the refrigeration process by avoiding the need for an accumulator that is otherwise employed for the purpose of providing a buffer for handling varying amounts of liquid-state working fluid in the system.

Another object of the present invention is to operate the refrigeration cycle with an oil-free working fluid and thereby simplify the refrigeration process by avoiding the need for an accumulator that is otherwise employed for the purpose of separating oil from the working fluid.

Another object of the present invention is to improve the efficiency of supercritical fluid refrigeration cycles over that of CFC refrigerants by operating the expansion and compression steps in such ways as to reduce thermodynamic irreversibitities. This includes the replacement of an expansion valve with a turbine for expansion, or the use of multi-stage compression, or a combination thereof.

Yet another object of this invention is to improve efficiency using a nontoxic and environmentally benign working fluid.

SUMMARY OF THE INVENTION

This invention relates to a method for refrigeration using a vapor compression cycle. The method includes the steps of:

(a) obtaining a natural, oil-free refrigerant;

(b) compressing the said refrigerant;

(c) transferring heat from the refrigerant to an external environment through one or more heat exchangers;

(d) expanding the said refrigerant isentropically;

(e) transferring heat from an external environment to the refrigerant through one or more heat exchangers;

(f) connecting the above mentioned components in a closed loop;

(g) circulating said refrigerant in said loop through a cycle involving supercritical high pressure and subcritical low pressure conditions;

(h) controlling the mass flow rate; and (i) refrigerating the external environment.

The said refrigerant is non-toxic and environmentally benign. The said refrigerant is selected from a group consisting of carbon dioxide, water, a hydrocarbon or a combination thereof. The said refrigerant can be compressed by a compressor, which may be of a reciprocating or centrifugal type. After giving up heat in a heat exchanger, the said refrigerant then is expanded in a turbine, which may be of an impulse or reaction type. The inlet mass flow to the compressor is varied by changing the compression stroke, changing the final compression volume or changing the speed of the compressor drive, wherein the efficiency of the turbine is more than 60%. The turbine produces useful work and may be energetically coupled with the compressor to recover energy.

At least 30% of the total volume of said refrigerant, operating in a vapor compression cycle according to the method described herein, occupies the low pressure side of the system. At least 15% of the total mass of said refrigerant, operating in a vapor compression cycle according to the method described herein, occupies the low pressure side of the system.

In further aspects of this invention, said refrigerant is expanded isentropically, thereby increasing capacity and efficiency. One or more intercoolers transfer useful heat from the high pressure side and to the low pressure side. One or more separators are used to separate gas and liquid. A combination of intercoolers and separators are used to transfer useful work from the high pressure side to the low pressure side and to separate gas and liquid. The oil-free refrigerant increases the efficiency of the cycle. Control of the mass flow rate is accomplished through control of compressor. The mass flow rate is controlled by one or more of the following means: varying the inlet mass flow to the compressor, changing the compression stroke, changing the final compression volume or changing the speed of the compressor drive.

This invention also relates to an apparatus for refrigeration using a vapor compression cycle. The apparatus consists of:

(a) a compressor to compress a natural, oil-free refrigerant;

(b) one or more heat exchangers for transferring heat from the refrigerant to an external environment;

(c) a turbine for isentropic expansion of the refrigerant;

(d) one or more heat exchangers for transferring heat from the refrigerant to an external environment;

(e) a closed loop for a fluid connection of the above mentioned components;

(f) means for circulating said refrigerant in said loop through a cycle involving (g) supercritical high pressure and subcritical low pressure conditions; and means to control the mass flow rate;

wherein, the components of the apparatus are of the type previously described so as to perform in accordance with the aforementioned methods of this invention.

BRIEF DESCRIPTION OF THE DRAWINGS

FIG. 1 is a generalized graph of the pressure-enthalpy relation for a conventional transcritical vapor compression cycle.

FIG. 2 is a schematic representation of the conventional transcritical vapor compression cycle that corresponds to the generalized relation shown in FIG. 1.

FIG. 3 is a generalized graph of the pressure-enthalpy relation of the preferred embodiment of this invention.

FIG. 4 is a schematic representation of the preferred embodiment of this invention.

DETAILED DESCRIPTION OF THE INVENTION

DEFINITIONS

"Centrifugal type" means

Having an rotating element producing centrifugal force

"Compressor" means

A device to increase the pressure of a fluid using mechanical, electrical, or magnetic means, or a combination thereof, in one or more stages "Compression stroke" means The length or dimension of the movement of the mechanical element in the compressor "Condensation" means The process of transferring heat from the closed loop to an external environment "Energetically coupled" means Having energy transferred from one element to another element "Evaporation" means The process of adding heat from an external environment to the closed circuit loop "Final compression volume" means The fraction of the starting volume that is occupied by the working fluid after compression "Impulse type" means A turbine consisting of a set of blades mounted on a rotor toward which a nozzle directs a fluid, causing the rotor to turn "Intercooler" means Exchanging heat between two elements within the cycle where the element that needs to be cooled transfers the heat to the element that need to be heated "Isentropic expansion" means Expanding the fluid to a lower pressure while keeping the entropy as close to constant as possible "Natural oil-free refrigerant" means Naturally occurring working fluid having no contact with lubricating oil at any point in the cycle "Reaction type" means A turbine consisting of a set of moving blades mounted on a rotor as well as a set of blades fixed on a non-moving stator, both sets of which act as nozzles that drive the fluid against the moving blades, causing the rotor to turn "Reciprocating type" means Having an element producing periodic pressure fluctuations "Separator" means A device for the separation of vapor and liquid in the closed loop "Subcritical" means A condition of the refrigerant where the pressure and temperature are below the refrigerant's critical pressure and temperature respectively "Supercritical" means A condition of the refrigerant where the pressure and temperature are above the refrigerant's critical pressure and temperature respectively "Transcritical cycle" means A cycle that includes supercritical and subcritical conditions of the refrigerant "Useful heat" means The heat that reduces the demand for external energy "Working fluid" means The material undergoing vapor compression, also referred to as the refrigerant

DESCRIPTION

The objects of this invention are achieved by implementing an equipment or equipments that circulate a working fluid in a closed loop, impelling said liquid by single or multiphase compression such that the fluid is compressed to a supercritical state, said state being maintained as the fluid then passes through a heat exchanger for purposes of exhausting heat to an external medium, such as air or water, whereupon the working fluid is expanded in a turbine and returned to a sub-critical pressure that existed prior to compression, whereupon the fluid condenses and drops to a temperature suitable for its use in absorbing heat in an evaporator.

In one aspect of this invention, the turbine expander provides a means for improving efficiency by recovering work energy from the working fluid along a thermodynamic path that is more nearly isentropic, as opposed to the less-efficient isenthalpic path if it were to undergo expansion through a throttling valve. In one aspect of this invention, such work may be used to supplement compressor work by coupling the turbine with the compressor, although such coupling is not a required aspect of this invention.

In another aspect of this invention, efficiency is increased in the heat rejecter by maintaining the working fluid in a supercritical state prior to entering the turbine for expansion. By controlling the compressor such that pressure rises, if necessary, to account for temperature changes in the ambient medium used to exchange heat at the rejecter, said changes of which might otherwise cause the working fluid to enter a subcritical phase or result in an insufficient temperature gradient between ambient and working fluids, with subsequent toss of heat transfer efficiency.

In stilt another aspect of this invention, the compressor is operated in two or more stages. However, this is not required to practice the present invention. Such multistage operation further improves efficiency.

In the preferred embodiment of this invention, working fluid is cycled through the refrigeration loop in a closed loop without the need for an accumulator that serves as a buffer to hold reserve quantities of working fluid, nor is there a need for an accumulator that serves to separate oil from the working fluid. By both simplifying the refrigeration device with the omission of said accumulator, together with the improved efficiency by operating with a turbine expander, possibly coupled to a compressor, and said compressor possibly operating in a multistage mode, the present invention provides a means for refrigeration in a more compact device, suitable for example, in small electronic equipments.

The present invention provides a novel method of refrigeration. The refrigerating method herein relates to a vapor compression cycle. The system is comprised of at least a compressor, which may be reciprocating or centrifugal, one or more heat exchangers, a turbine, with said components connected in a closed loop. The refrigerant of choice is nontoxic and environmentally benign. The refrigerant includes but not limited to carbon dioxide, water, a hydrocarbon or a combination thereof.

The addition of a turbine beyond normal throttling means through a valve modifies the expansion of the refrigerant from conventional isenthalpic expansion to near isentropic expansion. Such expansion enables the system to achieve both greater cooling capacity and cooling efficiency. The method of refrigeration and system thereof can be used in numerous cooling applications, including, but not limited to, commercial, residential, automotive, portable and electronics cooling.

The refrigerant that is used in the system, which can be water, carbon dioxide or a hydrocarbon, operates in a transcritical cycle. In the preferred embodiment of this invention, the refrigerant is carbon dioxide. The heat transfer efficiency is increased by elevating the refrigerant to a single-phase supercritical state, thereby eliminating heat transfer resistance arising from phase boundaries. FIG. 1 describes the conventional carbon dioxide cycle, which is a typical vapor compression system consisting of four stages: compression (AB), condensation (BC), expansion (CD) and evaporation (DA). FIG. 2 is a schematic diagram that shows the components needed for a refrigeration system (1) operating on this cycle. These components include a heat absorber (2), compressor (3) with motor (4), and heat rejecter (5). Circulating in a closed cycle through these components is the working fluid (6). Said working fluid gives up heat in the heat rejecter (5), exchanging the heat with the cooling ambient media (7). After exiting the heat rejecter, the working fluid enters the throttling valve (8), where it is expanded isenthalpicatty. After exiting the expansion throttle, the working fluid enters the heat absorber, where it cools a heat source that is represented by the wavy lines underneath the heat accepter.

The COP of such a cycle operating with carbon dioxide as the working fluid is generally tow. The COP can be increased with modifications that focus on the compression and expansion components, among others, in this cycle. One such modification is to replace the throttling valve with a turbine. Further modifications may include operating the compressor in two or more stages; or energetically coupling the turbine to the first stage of compression for the purpose of recovering useful work from the turbine expander and employing it to drive the compressor; or employing both multistage compression and coupling of the turbine and compressor. FIG. 3 describes an improved version of this cycle according to the preferred embodiment of this invention, in which a turbine is coupled to the compressor. It should be evident to anyone experienced in the art of refrigeration, however, that coupling of the turbine to the compressor is not a requirement for improved COP. Whether coupled or not, a turbine will cause expansion of the working fluid to follow a path that is more nearly isentropic than would be the case for expansion through a throttling valve, thus lowering the enthalpy of the working fluid to a greater degree than is the case of the throttling valve, which results in higher capacity to absorb heat for a given amount of working fluid. This extension of the enthalpy is evident in FIG. 3 by the curved line C–D', which follows a line of near constant entropy, in contrast to line C–D of FIG. 1, which follows a line of constant enthalpy. The COP of this cycle, with a turbine operating at 100% efficiency and single-stage compression, can be 35–45% higher, which is a large improvement from the COP of the standard cycle.

Examples of improvements to the Coefficient of Performance (COP) of the cycle by practicing the embodiments of the present invention are presented in Table 1. As can be seen in Table 1, either an intercooler or a turbine improve the COP, but a turbine improves COP to a greater degree.

Example 1

The COP of a cycle operating with a turbine in place of a throttling valve, but without an intercooler, rises 28%, from 2.12 to 2.93, at constant evaporator temperature of 5° C.

Example 2

The COP of a cycle operating with a turbine and no intercooler can be improved more than two times, from 2.93 to 6.15, by allowing the temperature at the evaporator inlet (or turbine outlet) to rise from 5° C. to 25° C.

TABLE 1

Refrigeration performance by Cycle Type

| | Evaporator | | Condenser Outlet | | |
|---|---|---|---|---|---|
| Cycle description | ° C. | Bar | ° C. | Bar | COP |
| Throttling valve | 5 | 39 | 40 | 98.6 | 2.12 |
| Intercooter and throttling vaLve | 5 | 39 | 40 | 98.6 | 2.26 |
| Turbine in place of throttling valve, no intercooler | 5 | 39 | 40 | 98.6 | 2.93 |

TABLE 1-continued

Refrigeration performance by Cycle Type

| | Evaporator | | Condenser Outlet | | |
|---|---|---|---|---|---|
| Cycle description | ° C. | Bar | ° C. | Bar | COP |
| Turbine in place of throttling valve, no intercooler | 30 | 71 | 50 | 103.6 | 1.04 |
| Turbine in place of throttling valve, no intercooler | 25 | 63.5 | 50 | 98.6 | 2.07 |
| Turbine in place of throttling valve, no intercooler | 18 | 53.9 | 40 | 98.6 | 4.56 |
| Turbine in place of throttling valve, no intercooler | 25 | 63.5 | 40 | 98.6 | 6.15 |

Under practical circumstances, however, the turbine is not expected to operate at 100% isentropic efficiency. Efficiency is in a range of 60% to 85% for impulse turbines, and 60% to 90% for reaction turbines. COP for a cycle operating with an impulse turbine at 85% efficiency is approximately 30–40% higher than the standard cycle and 1–2% more for a reaction turbine.

FIG. 4 depicts the components of a system (9) operating according to the cycle shown in FIG. 3. Working fluid (6) exits the heat absorber and enters the suction of the compressor (3) which is driven by motor (4) and which can receive supplementary power by coupling (11), although the use of said coupling is not a requirement of the invention. The fluid then moves in similar manner as in the standard cycle, through heat rejecter (5). The working fluid exits the heat rejecter and enters the turbine (10), where it undergoes expansion to the lower pressure of the heat accepter.

Other embodiments of the present invention include: (1) the insertion of an intercooler that exchanges heat indirectly between the working fluid exiting the heat rejecter and the working fluid exiting the heat accepter; and (2) the implementation of multiple-stage compression, with intermediate cooling of the working fluid, in place of single stage compression. The first of these other embodiments adds heat to the vapor going to the suction of the compressor thus reducing the Load on the compressor. The second modification reduces the overall amount of compression work required. Either one of these modifications may be implemented separately, or in combination.

In order to attain the highest possible COP, the working fluid must be maintained in a supercritical state between the outlet of the compressor and the inlet of the turbine. As is common in the art, we refer to this segment of the cycle as the "high" or "high pressure" side, with the remaining parts of the cycle being the "low" or "low pressure" side. To ensure supercritical conditions, pressure and mass flow in the high side is maintained by controlling the compressor. If pressure is increased, the turbine output also increases, which can result in higher useful work obtained from the turbine. Flow of the working fluid is maintained. To assure sufficient cooling capacity at the heat accepter, the volume of the working fluid in the tow side is maintained at least at 30% of the total refrigerant volume. In another preferred embodiment, the mass fraction of the working fluid in the low side is at least 15% of total refrigerant mass. Operating variables of temperature and pressure are chosen such that these conditions are maintained in the cycle so designed.

Control of the compressor can be accomplished by one or more of the following means: varying the inlet mass flow to the compressor, changing the compression stroke, changing the final compression volume or changing the speed of the compressor drive Another aspect of the preferred embodiment of this invention is that the fluid being compressed is oil-free, and for this reason, there is no need for the separation of oil from the working fluid. This combination of pressure and flow regulation by means of controlling the compressor, together with oil-free fluid compression, avoids the need for an accumulator at any point in the process.

TABLE 2

| Annotation of Drawings |
|---|
| 1 Cycle components |
| 2 Evaporator |
| 3 Compressor |
| 4 Motor |
| 5 Condenser |
| 6 Working fluid |
| 7 Ambient fluid |
| 10 Turbine |
| 11 Coupling shaft (optional) |

| REFERENCES CITED U.S. PATENT DOCUMENTS: | | |
|---|---|---|
| 3,677,019 | July 18, 1972 Olszewski | 62/9 |
| 4,086,072 | Apr. 25, 1978 Shaw | 62/2 |
| 4,170,116 | Oct. 9, 1979 Williams | 62/116 |
| 4,205,532 | June 3, 1980 Brenan | 62/115 |
| 4,539,816 | Sept. 10, 1985 Fox | 62/87 |
| 5,245,836 | Sept. 21, 1993 Lorentzen et al. | 62/174 |
| 5,405,533 | Apr. 11, 1995 Hazlebeck et al. | 210/634 |
| 5,497,631 | Mar. 12, 1996 Lorentzen et al. | 62/115 |
| 5,655,378 | Aug. 12, 1997 Pettersen | 62/174 |
| 5,684,160 | Nov. 11, 1997 Abersfelder et al. | 62/114 |
| 5,890,370 | Apr. 6, 1999 Sakakibara et al. | 62/222 |
| 6,185,955 | Feb. 13, 2001 Yamamoto | 62/470 |

OTHER PUBLICATIONS

Robinson, D. M. and Groll, E. A., "Efficiencies of transcritical $C_2$ cycles with and without an expansion turbine," *Int J. Refrig.*, Vol 21(7), pp. 577–589, 1998 Sasaki, M, et al., "The effectiveness of a refrigeration system using $C_2$ as a working fluid in the trans-critical region," *ASHRAE Transactions*, 2002 ASHRAE Winter Meeting, Atlantic City, N.J., pp. 413–418, 2002

Lorentzen, G., "Revival of carbon dioxide," *Int. J. Refrig.*, 17(5), pp. 292–301, 1994

Molina, M. J. and F. S. Rowland, "Stratospheric sink for chlorofluoromethanes-chlorine atom catalyzed destruction of ozone," *Nature*, 249, 810, 1974

I claim:

1. A method for refrigeration using a vapor compression cycle comprising:

(a) obtaining a natural, oil-free refrigerant;

(b) compressing the said refrigerant;

(c) transferring heat from the refrigerant to an external environment through one or more heat exchangers;

(d) expanding the said refrigerant isentropically;

(e) transferring heat from another external environment to the refrigerant through one or more heat exchangers;

(f) connecting the above mentioned components in a closed loop;

(g) circulating said refrigerant in said loop through a cycle involving supercritical high pressure and subcritical tow pressure conditions;

(h) controlling mass flow rate of the refrigerant; and (i) refrigerating the external environment in (e).

2. The method as in claim 1, wherein the said refrigerant is non-toxic and environmentally benign.

3. The method as in claim 1, wherein the said refrigerant is selected from a group consisting of carbon dioxide, water, a hydrocarbon or a combination thereof.

4. The method as in claim 1, wherein compressing the said refrigerant is accomplished by a compressor.

5. The method as in claim 4, wherein the said compressor is of reciprocating type.

6. The method as in claim 4, wherein the said compressor is of centrifugal type.

7. The method as in claim 4, wherein the control of the mass flow rate is accomplished through control of compressor.

8. The method as in claim 7, wherein the mass flow rate is controlled by one or more of the following means: varying the inlet mass flow to the compressor, changing the compression stroke, changing the final compression volume or changing the speed of the compressor drive.

9. The method as in claim 1, wherein expanding the said refrigerant is accomplished by a turbine.

10. The method as in claim 9 wherein the said turbine is of impulse type.

11. The method as in claim 9, wherein the said turbine is of reaction type.

12. The method as in claim 9, wherein the efficiency of the turbine is more than 60%.

13. The method as in claim 9, wherein the turbine produces useful work.

14. The method as in claim 9, wherein the said turbine is energetically coupled with the compressor to recover energy.

15. The methods as in any one of claims 1 through 14, wherein expanding said refrigerant insentropically increases cooling capacity.

16. The methods as in any one of claims 1 through 14, wherein expanding isentropically increases efficiency.

17. The method as in claim 1, wherein the refrigerant in the low pressure side is at least 30% of the total refrigerant volume.

18. The method as in claim 1, wherein the refrigerant in the low pressure side is at least 15% of the total mass of refrigerant in a system.

19. The method as in claim 1, wherein one or more intercoolers transfer useful heat from the high pressure side and to the low pressure side.

20. The method as in claim 1, wherein one or more separators are used to separate gas and liquid.

21. The method as in claim 1, wherein a combination of intercoolers and separators are used to transfer useful work from the high pressure side to the low pressure side and to separate gas and liquid.

22. The method as in claim 1, wherein the oil-free refrigerant increases the efficiency of the cycle.

23. An apparatus for refrigeration using a vapor compression cycle comprising:

(a) a compressor to compress a natural, oil-free refrigerant;

(b) one or more heat exchangers for transferring heat from the refrigerant to an external environment;

(c) a turbine for isentropic expansion of the refrigerant;

(d) one or more heat exchangers for transferring heat from the refrigerant to an external environment;

(e) a closed loop for a fluid connection of the above mentioned components;

(f) means for circulating said refrigerant in said loop through a cycle involving supercritical high pressure and subcritical low pressure conditions; and (g) means to control the mass flow rate.

24. The apparatus as in claim 23, wherein the said refrigerant is non-toxic and environmentally benign.

25. The apparatus as in claim 23, wherein the said refrigerant is selected from a group consisting of carbon dioxide, water, a hydrocarbon or a combination thereof.

26. The apparatus as in claim 23, wherein the said compressor is of reciprocating type.

27. The apparatus as in claim 23, wherein the said compressor is of centrifugal type.

28. The apparatus as in claim 23, wherein the said turbine is of impulse type.

29. The apparatus as in claim 23, wherein the said turbine is of reaction type.

30. The apparatus as in claim 23, varying the inlet mass flow to the compressor, changing the compression stroke, changing the final compression volume or changing the speed of the compressor drive wherein the efficiency of the turbine is more than 60%.

31. The apparatus as in claim 23, wherein the refrigerant in the low pressure side is at least 30% of the total refrigerant volume.

32. The apparatus as in claim 23, wherein the refrigerant in a low pressure side is at least 15% of the total mass of refrigerant in the system.

33. The apparatus as in claim 23, wherein the turbine produces useful work.

34. The apparatus as in claim 23, wherein the said turbine is energetically coupled with the compressor to recover energy.

35. The apparatus as in claim 33 or claim 34 with increased cooling capacity.

36. The apparatus as in claim 33 or claim 34 with increased energy efficiency.

37. The apparatus as in claim 23 with an addition of one or more intercooters to transfer useful work from the high pressure side to the low pressure side.

38. The apparatus as in claim 23 with an addition of one or more separators to separate gas from liquid.

39. The apparatus as in claim 23 with an addition of a combination of intercooters and separators to transfer useful work from the high pressure side and to separate gas from liquid.

40. The apparatus as in claim 37 or claim 38 or claim 39, wherein said addition increases the efficiency of the cycle.

41. The apparatus as in claim 23, wherein the oil-free refrigerant increases the efficiency of the cycle.

42. The apparatus as in claim 23, wherein the control of the mass flow rate is accomplished through control of one or more compressor heads.

43. The apparatus as in claim 42, wherein the compressor is controlled by one or more of the following means: means for varying an inlet mass flow to the compressor, means for changing a compression stroke, means for changing a final compression volume or changing the speed of the compressor drive.

* * * * *

UNITED STATES PATENT AND TRADEMARK OFFICE

CERTIFICATE OF CORRECTION

PATENT NO. : 6,698,214 B2
DATED : March 2, 2004
INVENTOR(S) : Lalit Chordia

It is certified that error appears in the above-identified patent and that said Letters Patent is hereby corrected as shown below:

Column 2,
Line 16, “Lorentzen et at” should read -- Lorentzen et al --

Column 3,
Line 15, “irreversibitities” should read -- irreversibilities --

Column 6,
Line 15, “stilt” should read -- still --

Column 7,
Line 2, “isenthalpicatty” should read -- Isenthalpically --
Line 7, “tow” shuld read -- low --
Line 54, delete the period after “5 ° C”
Table 1, “intercooter” should read -- intercooler --
Table 1, “vaLve” should read -- valve --

Column 8,
Line 43, “Load” should read -- load --
Line 59, “tow” should read -- low --

Column 9,
Line 2, “drive” should read -- drive. --
Line 42, “1998 Sasaki, M,…” should read -- 1998 (new line) Sasaki, M, --
Line 43, “$C_2$” should read -- $CO_2$ --

Column 10,
Line 35, “insentropically” should read -- isentropically --

UNITED STATES PATENT AND TRADEMARK OFFICE

CERTIFICATE OF CORRECTION

PATENT NO. : 6,698,214 B2
DATED : March 2, 2004
INVENTOR(S) : Lalit Chordia

It is certified that error appears in the above-identified patent and that said Letters Patent is hereby corrected as shown below:

Column 12,
Line 9, “intercooter” should read -- intercooler --

Signed and Sealed this

Eleventh Day of May, 2004

JON W. DUDAS
*Acting Director of the United States Patent and Trademark Office*